US006679223B2

(12) United States Patent
Sakakibara

(10) Patent No.: US 6,679,223 B2
(45) Date of Patent: Jan. 20, 2004

(54) ENGINE CONTROL SYSTEM WITH CAM SENSOR

(75) Inventor: Koji Sakakibara, Hekinan (JP)

(73) Assignee: Denso Corporation, Kariya (JP)

( * ) Notice: Subject to any disclaimer, the term of this patent is extended or adjusted under 35 U.S.C. 154(b) by 117 days.

(21) Appl. No.: 10/126,964

(22) Filed: Apr. 22, 2002

(65) Prior Publication Data

US 2002/0157641 A1 Oct. 31, 2002

(30) Foreign Application Priority Data

Apr. 20, 2001 (JP) ..... 2001-123081

(51) Int. Cl.[7] ..... F02D 43/04

(52) U.S. Cl. ..... 123/406.47; 123/406.62; 123/476; 123/90.15

(58) Field of Search ..... 123/90.15, 90.16, 123/90.17, 491, 476, 406.47, 406.53, 406.58, 406.62, 406.63

(56) References Cited

U.S. PATENT DOCUMENTS 4,338,813 A * 7/1982 Hunninghaus et al. ..... 73/116
5,209,202 A * 5/1993 Maurer et al. ..... 123/406.18
5,245,968 A * 9/1993 Kolias et al. ..... 123/480
5,329,904 A 7/1994 Kokubo et al. ..... 123/406.53
5,497,748 A 3/1996 Ott et al. ..... 123/406.62
5,979,413 A * 11/1999 Ohnuma et al. ..... 123/491
6,302,085 B1 * 10/2001 Sekine et al. ..... 123/406.62
6,460,526 B1 * 10/2002 Ward ..... 123/612
2002/0078925 A1 * 6/2002 Kobayashi ..... 123/406.18
2003/0163247 A1 * 8/2003 Kobayashi et al. ..... 701/114

FOREIGN PATENT DOCUMENTS

JP 5-312089 11/1993

* cited by examiner

*Primary Examiner*—Mahmoud Gimie
*Assistant Examiner*—Hai Huynh
(74) *Attorney, Agent, or Firm*—Nixon & Vanderhye P.C.

(57) ABSTRACT

An engine control system executes fuel injection and ignition in accordance with a detected engine rotational position. The engine control system has a crank sensor on a crankshaft and a cam sensor on a camshaft. The crank sensor generates a first reference position signal at intervals of 360 degrees CA. The cam sensor generates a second reference position signal at a rotational position different from the crank sensor. The engine control system also includes a means for controlling the engine on the basis of the first reference position signal and a means for controlling the engine on the basis of the second reference position signal. When the engine is started, either of the signals is detected so that it is possible to control the engine in accordance with a rotational position of the engine early. The cam sensor is also used in control of a variable valve timing unit.

20 Claims, 11 Drawing Sheets

| MRE 9 | Lo | Lo | Lo | Hi | Hi | Hi | Hi |
|---|---|---|---|---|---|---|---|
| MRE 18 | ↑ | ↓ | ↑ | ↓ | ↑ | ↓ | ↓ |
| Scm_EstCrnk | [4] | [13] | [22] | [30] | [39] | [48] | [57] | [65] |
| ATDC30°CA | #1A | #1B | #4A | #2A | #2B | #3A | #3B | #4B |

| FIG. 12A | FIG. 12B |
|---|---|

| FIG. 13A | FIG. 13B |
|---|---|

ENGINE CONTROL SYSTEM WITH CAM SENSOR

CROSS REFERENCE TO RELATED APPLICATION

This application is based on Japanese Patent Application No. 2001-123081 filed on Apr. 20, 2001 the contents of which are incorporated herein by reference.

BACKGROUND OF THE INVENTION

1. Field of the Invention

The present invention relates to an engine control system with a cam sensor.

2. Description of the Related Art

The power for moving a car is generated by an internal combustion engine, which is also referred to hereafter simply as an engine. The engine is controlled by an engine control system. For example, the engine control system controls the engine's injection of fuel and ignition timings in accordance with operating conditions of the car or operating conditions of the engine. The engine is controlled by injecting fuel into each cylinder or by carrying out an ignition for a certain stroke with a predetermined timing. It is thus necessary to identify the rotational position of the engine, that is, the rotational position or the rotational angle of the crankshaft, in order to execute the control of the engine. Processing to identify the rotational position of the engine is referred to as cylinder identifying processing in the case of a multi-cylinder engine. In the case of a multi-cylinder 4-stroke engine, for example, a reference position signal is used. This signal is detected only once in a rotation of the crankshaft. For instance, a crank sensor is provided in such a way that the reference position signal is generated when a specific one of the cylinders is positioned at the beginning of an air intake process. From the signal generated by the crank sensor, the engine control system identifies a cylinder that has arrived at a fuel-injection timing. Furthermore, the engine control system adjusts the fuel-injection timing to an optimum position. The engine control system can have a configuration typically based on a microcomputer and implementation of a fuel-injection timing and an ignition timing is controlled by using a timer.

A crank sensor comprises typically 34 teeth separated from each other by an angle of 10 degrees, leaving 2 consecutive locations each having no tooth as a reference position. In this configuration, the reference position may not be detected till a time corresponding to a maximum of 360 degrees CA (Crank Angle) lapses since a start of the engine. Thus, actions such as injection of fuel cannot be carried out till a time corresponding to the 360 degrees CA lapses since the activation of a starting motor by the driver. As a result, it may take a long time to start the engine.

In order to solve the above problem, there is provided a known conventional technology whereby fuel is injected asynchronously with the revolution of the engine till a reference position is detected. With such asynchronous injection of fuel, however, fuel cannot be injected with a proper timing. In addition, fuel cannot be injected into each cylinder at a proper volume. Thus, it is difficult to shorten the start period of the engine. In addition, it is feared that the emission worsens due to the asynchronous injection of fuel.

SUMMARY OF THE INVENTION

It is thus an object of the present invention to provide an engine control system capable of identifying the rotational position of the engine at an early time.

It is another object of the present invention to provide an engine control system having an improved start characteristic.

It is a further object of the present invention to provide an engine control system having an improved start characteristic and improved emission.

It is a still further object of the present invention to improve the start characteristic of an engine having a variable valve timing unit.

In accordance with a first aspect of the present invention, an engine control system employed in a multi-cylinder engine is provided with a crank sensor and a cam sensor. The engine control system further has a second identifying means for identifying a rotational position of the engine on the basis of a signal output by the cam sensor and a first identifying means for identifying a rotational position of the engine on the basis of a signal output by the cam sensor and a signal output by the crank sensor. In this configuration, there is provided the second identifying means for identifying a rotational position of the engine by using the cam sensor besides to the first identifying means for identifying a rotational position of the engine by using the crank sensor. Thus, since either of the identifying means identifies a rotational position of the engine, the rotational position of the engine can be recognized at an early time. As a result, the engine can be controlled at the early time in accordance with the rotational position of the engine.

In accordance with a second aspect of the present invention, an engine control system is provided with a first cam sensor installed on a first camshaft and a second cam sensor set on a second camshaft. The engine control system further has a cylinder identifying means for identifying a rotational position of the engine on the basis of a signal output by the first cam sensor and a signal output by the second cam sensor. In this configuration, a rotational position of the engine can be identified by using only 2 cam sensors.

In accordance with a third aspect of the present invention, an engine control system is provided with a crank sensor for generating a signal indicating a first reference position and a cam sensor for generating a signal indicating a second reference position different from the first reference position. The signals generated by the crank and cam sensors are used for controlling a variable valve timing unit. The first reference position detected by the crank sensor is used by a first engine control means to control the engine. On the other hand, the second reference position detected by the cam sensor is used by a second engine control means to control the engine at least during a period of time ending with first detection of the first reference position. With this configuration, when the engine is started, either the first reference position or the second reference position is detected first. Thus, the engine can be controlled at an early time in accordance with the rotational position. In addition, the cam sensor can be utilized also for controlling the variable valve timing unit.

BRIEF DESCRIPTION OF THE DRAWINGS

Features and advantages of embodiments will be appreciated, as well as methods of operation and functions of the related parts, from a study of the following detailed description, the appended claims, and the drawings, all of which form a part of this application. In the drawings:

DETAILED DESCRIPTION OF PREFERRED EMBODIMENTS

First Embodiment

Figure 1:
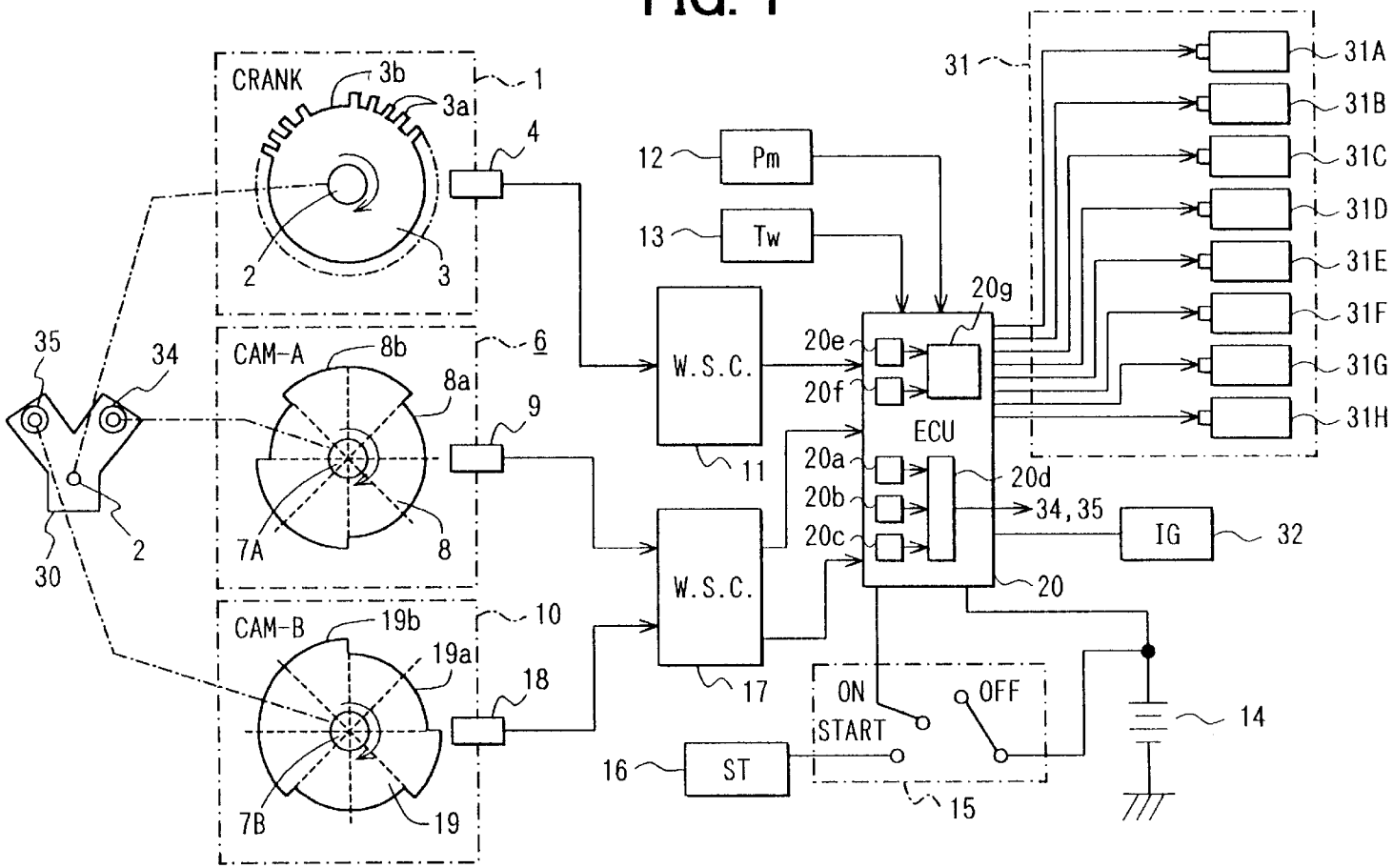
FIG. 1 is a block diagram showing an engine control system implemented by a first embodiment of the present invention.
Figures 2, 3:
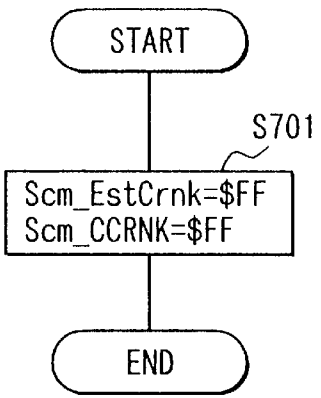
FIG. 2 is a table showing cylinder identifying processing in the first embodiment of the present invention.
FIG. 3 is a flowchart representing initialization processing in the first embodiment of the present invention.

By referring to some of the diagrams, the following description explains a first embodiment implementing an engine control system of a 4-cycle V-type 8-cylinder engine. FIG. 1 is a block diagram showing the engine control system. FIG. 2 is a table showing relations between cam-sensor outputs and the engine's rotational positions for cylinders. FIGS. 3 to 11 are each flowchart representing operations of the engine control system and FIGS. 12A and 12B are each timing charts.

In the engine control system shown FIG. 1, reference numeral 30 denotes a spark-ignition 4-cycle V-type 8-cylinder engine. The engine 30 has banks A and B. On a camshaft 7A for driving an intake valve of bank A, a variable valve timing unit (VCT) 34 is provided. By the same token, on a camshaft 7B for driving an intake valve of bank B, a variable valve timing unit (VCT) 35 is provided. The camshafts 7A and 7B are driven by a crankshaft 2. When the crankshaft 2 rotates by 1 rotation, the camshafts 7A and 7B each rotate by 1/2 rotations. In this embodiment, the A bank's first, second, third and fourth cylinders are denoted by reference numerals #1A, #2A, #3A and #4A respectively. By the same token, the B bank's first, second, third and fourth cylinders are denoted by reference numerals #1B, #2B, #3B and #4B respectively. The combustion order of the engine 30 is #1A→#1B→#4A→#2A→#2B→#3A→#3B→#4B→#1A. On each of the camshafts 7A and 7B, a cam profile corresponding to the combustion order is created.

On the crankshaft 2 of the engine 30, a crank sensor 1 is provided. The crank sensor 1 has a crank rotor 3 fixed on the crankshaft 2 of the engine 30 and a magnetic pickup coil 4, which is referred to hereafter as an MPU 4. On the circumference of the crank rotor 3, teeth 3*a* are provided at intervals of 10 degrees CA(crank angle). No tooth is provided at one tooth location, which is referred to as a no-tooth portion 3*b*. Thus, when the crankshaft 2 rotates by 1 rotation, the crank sensor 1 outputs 35 pulses. In 1 operating cycle of the engine 30, the crankshaft 2 rotates by 720 degrees CA, causing the crank sensor 1 to output 70 pulses.

On the camshaft 7A, a cam sensor 6 is provided. The cam sensor 6 has a cam rotor 8 provided on the camshaft 7A and a magnetic resistor element 9, which is referred to hereafter as an MRE 9. The MRE 9 detects a flux that varies in accordance with a distance to the cam rotor 8. The cam rotor 8 has a circumferential shape shown in FIG. 1. The cam rotor 8 has 2 dents 8*a* and 2 protrusions 8*b*. The MRE 9 generates a signal having a waveform representing the circumferential shape of the cam rotor 8. In this embodiment, the signal generated by the MRE 9 has 2 values represented respectively by Hi (high) and Lo (low) levels of the signal. In this embodiment, the low level, the rising edge and the falling edge of the signal are detected. By the same token, on the camshaft 7B, a cam sensor 10 is provided. The cam sensor 10 has a cam rotor 19 provided on the camshaft 7B and an MRE 18. The cam rotor 19 has a circumferential shape different from that of the cam rotor 8.

The circumferential shapes of the cam rotors 8 and 19 are designed so that they exhibit relationship with each other. The cam rotor 19 also has 2 dents 19*a* and 2 protrusions 19*b*. The front and rear edges of each of the protrusions 19*b* of the cam rotor 19 are set in respectively the Hi and Lo periods of the cam rotor 8. On the other hand, the front and rear edges of each of the protrusions 8*b* of the cam rotor 8 are set in respectively the Hi and Lo periods of the cam rotor 19. Furthermore, the protrusions 8*b* and 19*b* are laid out in 45-degree (90-degree-CA) units. When the camshaft 7A rotates by a rotation, the cam sensor 6 generates at least 4 signal changes, which are equal to half a cylinder count of 8. By the same token, when the camshaft 7B rotates by a rotation, the cam sensor 10 also generates at least as many signal changes as half the number of cylinders. The circumferential shapes of the cam rotors 8 and 19 are designed so that the output of the MRE 9 or 18 is about to rise from a low level to a high level or fall from a high level to a low level for each 45 degrees. The locations of the rising and falling edges correspond to the position of the ATDC 30 degrees of each cylinder. It should be noted that, in this embodiment, in a state where the timing of the intake valve is retarded by the VCT 34 and the VCT 35 to a position proper for the start of the engine 30, the locations of the rising and falling edge coincide with the position of the ATDC 30 degrees. The 2 cam sensors 6 and 10 prescribe as many reference positions as cylinders of the engine 30 and outputs signals indicating the reference positions. In this embodiment, since the number of cylinders is 8, the number of reference positions is also 8. As a result, the signals output by the 2 MREs 9 and 18 identify a rotational position of the engine 30. For example, it is possible to identify which of the 8 cylinders is in an air intake process. The crank sensor 1 outputs a reference position signal for 360 degrees CA. On the other hand, the cam sensors 6 and 10 generate at least a signal indicating a reference position during a period in which no reference signal is obtained from the crank sensor 1. In this embodiment, when a signal output by one of the cam sensors 6 and 10 changes, a specific reference position in the range of 720 degrees CA is indicated by the level of a signal output by the other cam sensor. In this embodiment, the cam sensors 6 and 10 can be used for indicating 8 reference positions. It should be noted that Hall-effect devices can be used as substitutes for the MREs 9 and 18.

The crank sensor 1 is connected to a waveform-shaping circuit 11. The waveform-shaping circuit 11 shapes a waveform of a signal output by the crank sensor 1 on the basis of a predetermined threshold. The waveform-shaping circuit 11 outputs a binary signal representing the circumferential shape of the crank rotor 3. This signal is called a crank-angle signal Ne. The cam sensors 6 and 10 are connected to a waveform-shaping circuit 17. The waveform-shaping circuit 17 removes noises from output signals by using a filter and shapes waveforms by using a comparator. The waveform-shaping circuit 17 generates a binary signal representing the circumferential shape of the cam rotor 8 and a binary signal representing the circumferential shape of the cam rotor 19. The signals output by the waveform-shaping circuit 17 are referred to as cam-angle signals Ca and Cb. The signals output by the waveform-shaping circuits 11 and 17 are supplied to an ECU 20. The ECU 20 detects a TDC prior to combustion processes of specific cylinders of the engine 30 on the basis of the crank-angle signal Ne as well as the cam-angle signals Ca and Cb. For example, the ECU 20 detects a TDC of combustion processes of cylinders #2A and #4B.

The configuration of the ECU 20 is based on a microcomputer. Specifically, the ECU 20 comprises logic processing circuits including a CPU, memories such as a ROM for storing programs, a RAM for storing various kinds of data and a backup RAM, an input/output circuit as well as a bus line. The ECU 20 computes an engine revolution speed on the basis of the crank-angle signal Ne. In addition, the ECU 20 inputs signals generated by a variety of sensors. For example, the ECU 20 inputs an intake air pressure signal Pm from an intake air pressure sensor 12 and a cooling water temperature signal Tw from a cooling water sensor 13.

The ECU 20 controls a fuel-injection unit 31 and an ignition unit 32. The fuel-injection unit 31 has a plurality of fuel-injection valves 31A to 31H. The fuel-injection valves 31A to 31H are provided on the intake pipes of the cylinders. The ignition unit 32 has an ignition plug provided on each of the cylinders. The ignition unit 32 generates an ignition spark for an ignition plug specified by the ECU 20. The ECU 20 computes a fuel injection volume on the basis of sensor signals. In addition, the ECU 20 identifies a rotational position of the engine 30 on the basis of signals received from the crank sensor 1, the cam sensor 6 and the cam sensor 10 and controls the ignition unit 32 so as to generate a spark for an ignition plug provided for a cylinder corresponding to the identified rotational position.

The ECU 20 is connected to a battery 14. The ECU 20 is also connected to an ignition switch 15. The ignition switch 15 is provided with OFF, ON and START positions. When the driver changes over the ignition switch 15 from the OFF position to the ON position, an activation signal is supplied to the ECU 20, causing the ECU 20 to execute a variety of programs. When the ignition switch 15 is further changed over to the START position, the battery 14 supplies power to a starting motor 16 to crank the engine 30 with the ECU 20 continuing its operation. It should be noted that, in this embodiment, a start period is defined as a period starting with an operation carried out by the starting motor 16 to crank the engine 30 and ending with the start of a rotation of the engine 30 itself.

As shown in table of FIG. 2, each combination of signals output by the cam sensors 6 and 10 indicates the engine's rotational position corresponding to the ATDC 30 degrees CA of a cylinder. In the table shown in FIG. 2, an arrow symbol represents a rising or falling edge of a signal. Scm_EstCrnk is the contents of an estimated crank counter set by the signals generated by the cam sensors 6 and 10. In this embodiment, a combination of the signals generated by the 2 cam sensors 6 and 10 is used to identify a rotational position of the engine 30. Concretely, the rotational position corresponding to the ATDC 30 degrees CA of each of the 8 cylinders is detected as a combination of states of the signals generated by the cam sensors 6 and 10. In a combination, the signal generated by one of the cam sensors 6 and 10 can be about to rise from a low level to a high level, to fall from a high level to a low level, at a low level or a high level while the signal generated by the other cam sensor can be about to rise from a low level to a high level, to fall from a high level to a low level, at a low level or a high level.

By referring to flowcharts, the following description explains processing carried out by the ECU 20 of this embodiment.

FIG. 3 is a flowchart representing initialization processing, which is carried out typically right after an activation signal is supplied to the ECU 20 or right after the engine 30 is stalled. At a step S701, the contents of the estimated crank counter Scm_EstCrnk and a crank counter Scm_CCRNK are initialized at $FF. Then, the execution of this routine is ended.

Figure 4:
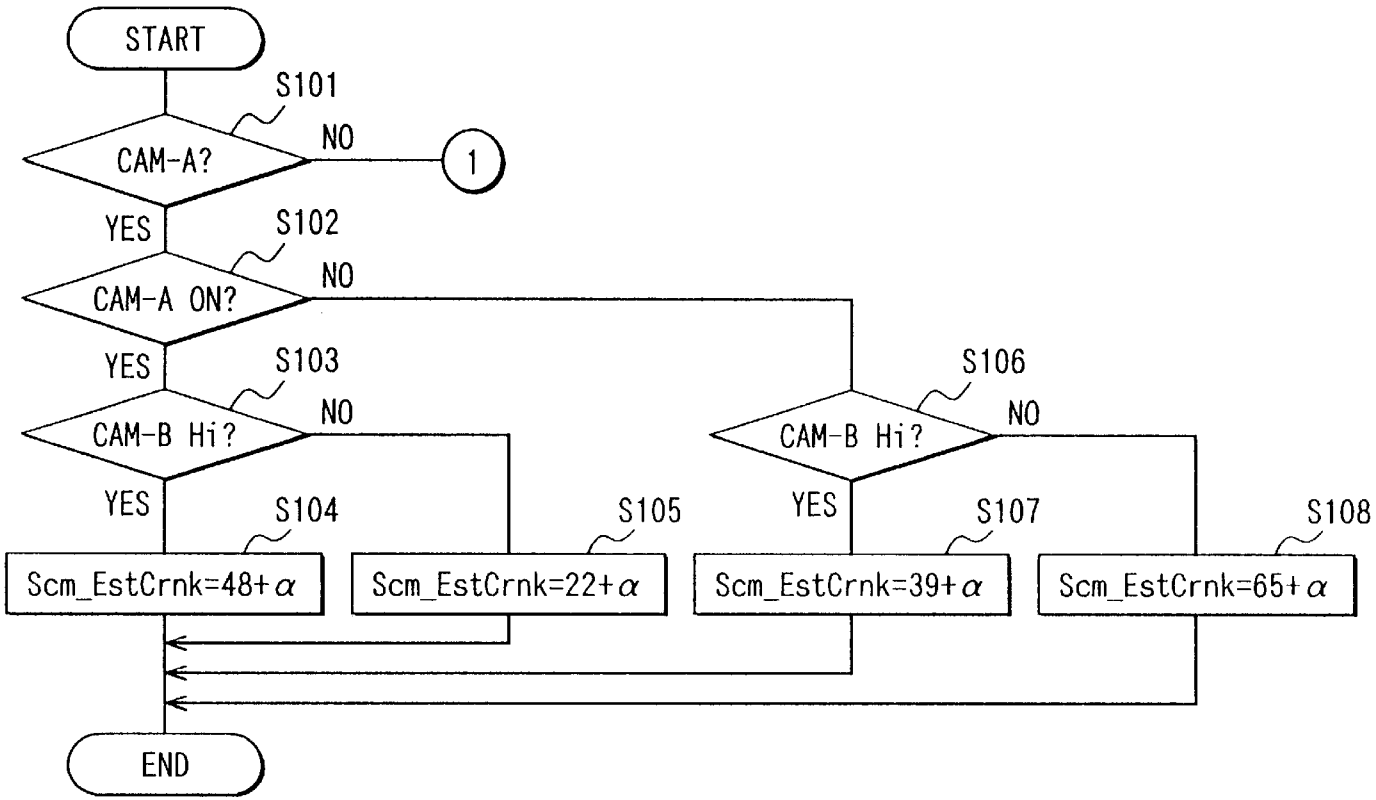
FIG. 4 is a flowchart representing second identifying processing in the first embodiment of the present invention.
Figure 5:
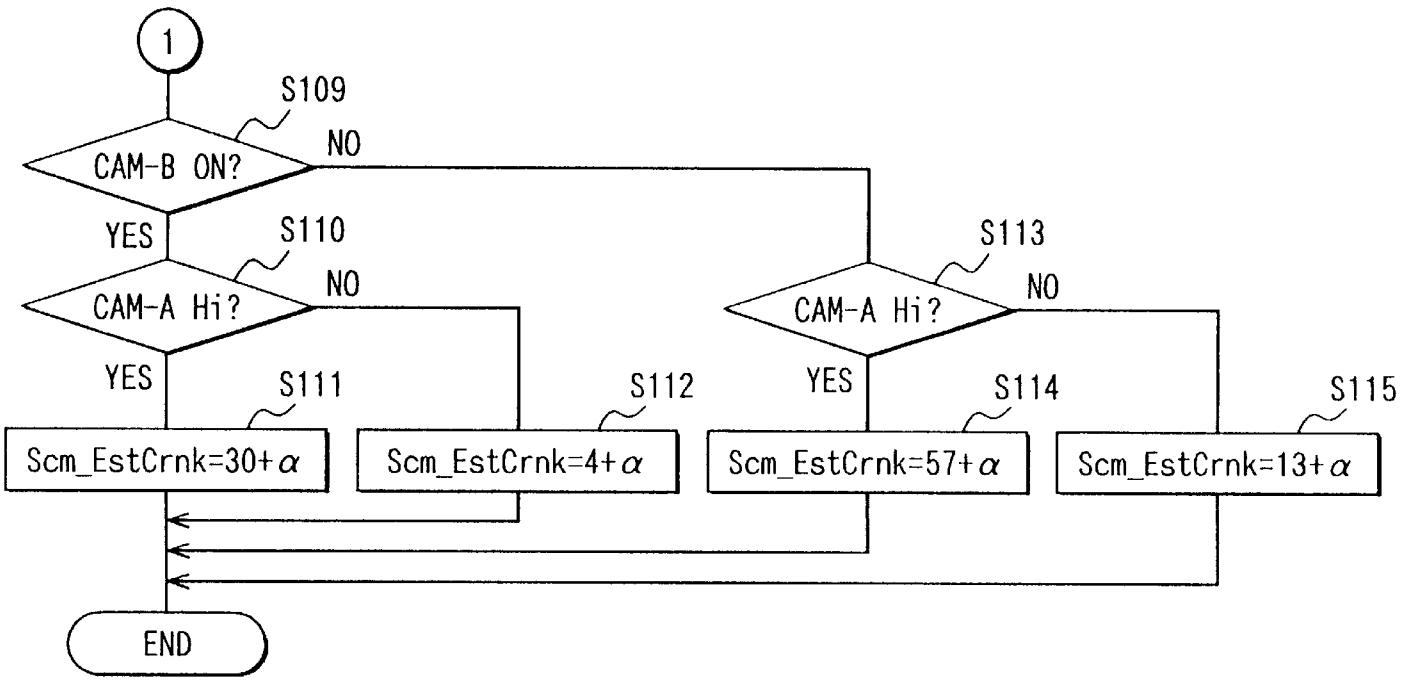
FIG. 5 is a flowchart representing the second identifying processing in the first embodiment of the present invention.

When the driver operates the ignition switch 15 to activate the starting motor 16, the engine 30 is cranked. At the same time, the ECU 20 executes programs to carry out normal cylinder identifying processing referred to as first identifying processing and tentative cylinder identifying processing referred to as second identifying processing. FIGS. 4 and 5 show a flowchart representing the second identifying processing. This processing is interrupt processing, which is activated each time a rising or falling edge of the signal generated by the cam sensor 6 or 10 is detected. In this processing, a count value indicating a rotational position of the crankshaft 2 is set in accordance with a combination of states of the signals generated by the cam sensors 6 and 10 as shown in FIG. 2. This count value is referred to as the contents of the estimated crank counter Scm_EstCrnk.

If an edge of the signal generated by the cam sensor 6 is detected at a step 101, the flow of the processing goes on to a step 102. The steps 101, 102 and other steps xyz in this flowchart as well as other flowcharts are referred to hereafter as S101, S102 and Sxyz respectively. At S102, the edge of the signal generated by the cam sensor 6 is examined to determine whether the edge is a rising or falling edge. If the edge of the signal generated by the cam sensor 6 is determined to be a rising edge, the flow of the processing goes on to S103. At S103, the signal generated by the cam sensor 10 is examined to determine whether the level of the signal is Hi or Lo. If the level of the signal generated by the cam sensor 10 is determined to be Hi, the flow of the processing goes on to S104. If the level of the signal generated by the cam sensor 10 is determined at S103 to be Lo, on the other hand, the flow of the processing goes on to S105.

At S104, the contents of the estimated crank counter Scm_EstCrnk are set at $(48+\alpha)$ and then the execution of this routine is ended. The count value of 48 indicates the ATDC 30 degrees CA of cylinder #3A. The symbol $\alpha$ is a correction value. The correction valued is $\alpha$ value for correcting shifts between the crank rotor 3 and the cam rotors 8 and 19 and learned during the operations of the engine 30.

At S105, the contents of the estimated crank counter Scm_EstCrnk are set at $(22+\alpha)$ and then the execution of this routine is ended. The count value of 22 indicates the ATDC 30 degrees CA of cylinder #4A.

If the edge of the signal generated by the cam sensor 6 is determined at S102 to be a falling edge, on the other hand, the flow of the processing goes on to S106. At S106, the signal generated by the cam sensor 10 is examined to determine whether the level of the signal is Hi or Lo. If the level of the signal generated by the cam sensor 10 is determined to be Hi, the flow of the processing goes on to S107. If the level of the signal generated by the cam sensor 10 is determined at S106 to be Lo, on the other hand, the flow of the processing goes on to S108.

At S107, the contents of the estimated crank counter Scm_EstCrnk are set at (39+α) and then the execution of this routine is ended. The count value of 39 indicates the ATDC 30 degrees CA of cylinder #2B. At S108, the contents of the estimated crank counter Scm_EstCrnk are set at (65+α) and then the execution of this routine is ended. The count value of 65 indicates the ATDC 30 degrees CA of cylinder #4B.

If an edge of the signal generated by the cam sensor 10 is detected S101, on the other hand, the flow of the processing goes on to S109 of a flowchart shown in FIG. 5. At S109, the edge of the signal generated by the cam sensor 10 is examined to determine whether the edge is a rising or falling edge. If the edge of the signal generated by the cam sensor 10 is determined to be a rising edge, the flow of the processing goes on to S110. At S110, the signal generated by the cam sensor 6 is examined to determine whether the level of the signal is Hi or Lo. If the level of the signal generated by the cam sensor 6 is determined to be Hi, the flow of the processing goes on to S111. At S111, the contents of the estimated crank counter Scm_EstCrnk are set at (30+α) and then the execution of this routine is ended. The count value of 30 indicates the ATDC 30 degrees CA of cylinder #2A. If the level of the signal generated by the cam sensor 6 is determined at S110 to be Lo, on the other hand, the flow of the processing goes on to S112. At S112, the contents of the estimated crank counter Scm_EstCrnk are set at (4+α) and then the execution of this routine is ended. The count value of 4 indicates the ATDC 30 degrees CA of cylinder #1A.

If the edge of the signal generated by the cam sensor 10 is determined at S109 to be a falling edge, on the other hand, the flow of the processing goes on to S113. At S113, the signal generated by the cam sensor 6 is examined to determine whether the level of the signal is Hi or Lo. If the level of the signal generated by the cam sensor 6 is determined to be Hi, the flow of the processing goes on to S114. At S114, the contents of the estimated crank counter Scm_EstCrnk are set at (57+α) and then the execution of this routine is ended. The count value of 57 indicates the ATDC 30 degrees CA of cylinder #3B. If the level of the signal generated by the cam sensor 6 is determined at S113 to be Lo, on the other hand, the flow of the processing goes on to S115. At S115, the contents of the estimated crank counter Scm_EstCrnk are set at (13+α) and then the execution of this routine is ended. The count value of 13 indicates the ATDC 30 degrees CA of cylinder #1B.

As a result, in the second identifying processing, a count value indicating the ATDC 30 degrees CA of a cylinder is set in the estimated crank counter Scm_EstCrnk in accordance with a combination of states of the signals generated by the cam sensors 6 and 10. In this embodiment, a count value is set with timings corresponding to intervals of 45 degrees on the cam rotors 8 and 19. That is, a count value is set with timings corresponding to intervals of 90 degrees on the crankshaft 2. Thus, when the engine 30 is cranked, a count value can be set in the estimated crank counter Scm_EstCrnk at least before completion of a 90-degree-CA rotation.

Figure 6:
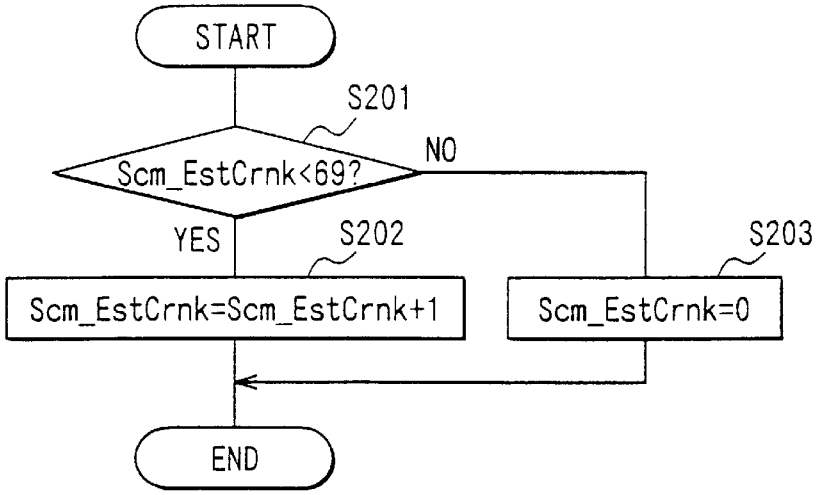
FIG. 6 is a flowchart representing the second identifying processing in the first embodiment of the present invention.

The contents of the estimated crank counter Scm_EstCrnk are incremented by count processing in accordance with the rotation of the crankshaft 2. This count value indicates a rotational position of the engine 30. FIG. 6 is a flowchart representing count processing in the first embodiment of the present invention. This processing is interrupt processing activated in response to a pulse output by the crank sensor 1. In this embodiment, 70 pulses are generated by the crank sensor 1 in 1 cycle of the engine 30. In this processing, the count value is reset every 2 rotations of the crankshaft 2.

At S201, the estimated crank counter Scm_EstCrnk is compared with a count value of 69. If the estimated crank counter Scm_EstCrnk is found smaller than the count value of 69, the flow of the processing goes on to S202. At S202, the estimated crank counter Scm_EstCrnk is incremented by 1. Then, the execution of this routine is ended. If the estimated crank counter Scm_EstCrnk is found at S201 to be not smaller than the count value of 69, on the other hand, the flow of the processing goes on to S203. At S203, the estimated crank counter Scm_EstCrnk is set at 0. Then, the execution of this routine is ended. Thus, once a count value is set in the estimated crank counter Scm_EstCrnk in the second identifying processing, the count value is thereafter updated in accordance with a signal generated by the crank sensor 1. That is, after an initial value is set in the estimated crank counter Scm_EstCrnk by the signals generated by the cam sensors 6 and 10 at a relatively low resolution, a rotational position of the engine 30 can be detected with a high degree of precision by using a signal generated by the crank sensor 1 at a high resolution.

Figure 7:
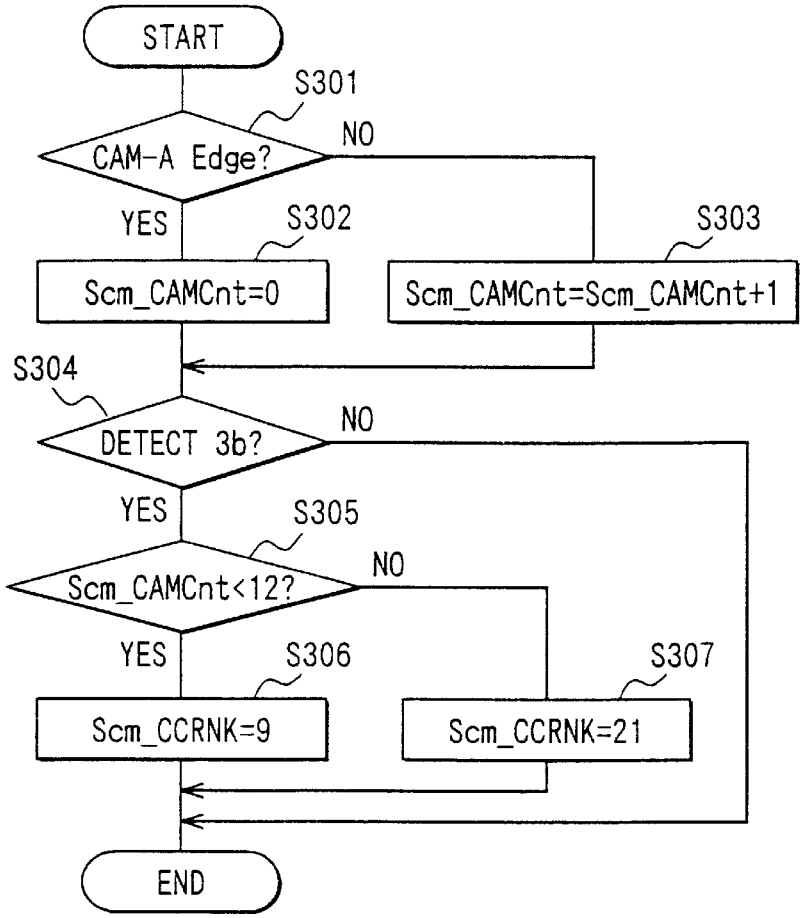
FIG. 7 is a flowchart representing first identifying processing in the first embodiment of the present invention.

In this embodiment, the first identifying processing is further carried out. FIG. 7 is a flowchart representing the first identifying processing. This processing is interrupt processing activated in response to a signal generated by the crank sensor 1. At S301, a signal generated by the cam sensor 6 is monitored to determine whether an edge of the signal is detected. If a result of determination found at S301 indicates that an edge of the signal is detected, the flow of the processing goes on to S302. At S302, a cam counter Scm_CAMCnt is reset at 0. Then, the flow of the processing goes on to S304. If a result of determination found at S301 indicates that an edge of the signal is not detected, on the other hand, the flow of the processing goes on to S303. At S303, the cam counter Scm_CAMCnt is incremented by 1. Then, the flow of the processing goes on to S304. As a result, the cam counter Scm_CAMCnt is incremented by 1 each time a signal is generated by the crank sensor 1 and reset to 0 on an edge of a signal generated by the cam sensor 6.

At S304, the crank rotor 3 is detected to determine whether a no-tooth portion 3*b* of the crank rotor 3 is detected. If a no-tooth portion 3*b* of the crank rotor 3 is not detected, the execution of this routine is ended. If a no-tooth portion 3*b* of the crank rotor 3 is detected, on the other hand, the flow of the processing goes on to S305 to determine whether the cam counter Scm_CAMCnt is greater than 12. If the cam counter Scm_CAMCnt is found greater than 12, the flow of the processing goes on to S307. At S307, a crank counter Scm_CCRNK is set at a count value of 21 and, then, the execution of the routine is ended. If the cam counter Scm_CAMCnt is found smaller than 12 at S305, on the other hand, the flow of the processing goes on to S306. At S306, the crank counter Scm_CCRNK is set at a count value of 9 and, then, the execution of the routine is ended. As a result, it is possible to determine whether the crankshaft 2 in the first half cycle of 1 cycle or the second half cycle of 1 cycle.

Figure 8:
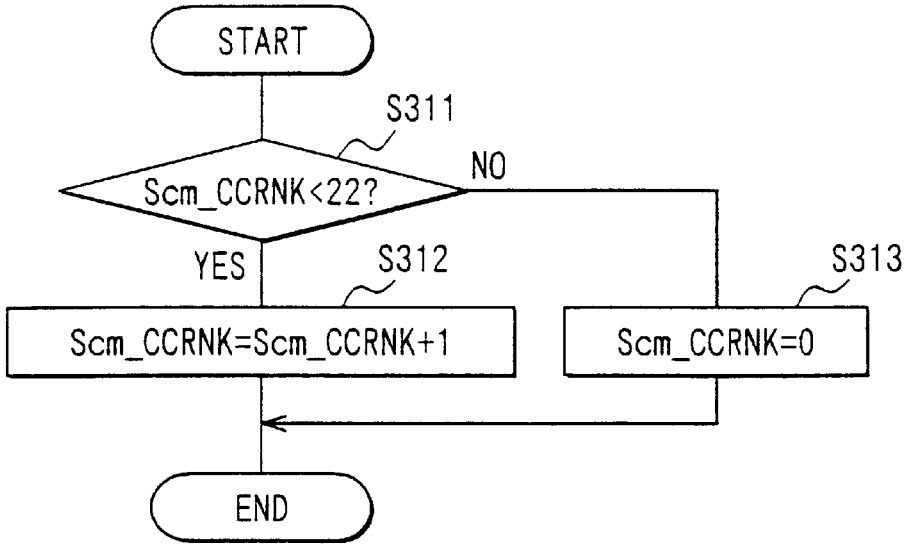
FIG. 8 is a flowchart representing other first identifying processing in the first embodiment of the present invention.

FIG. 8 is a flowchart representing processing to increment the crank counter Scm_CCRNK. The processing of the flowchart's S311 and S313 is carried out repeatedly to increment the crank counter Scm_CCRNK by 1 at one time from 0 to 22. This processing is activated at intervals of 30 degrees CA in response to a signal generated by the crank sensor 1. In the first identifying processing, a rotational position of the crankshaft 2 is identified on the basis of a reference position provided by the crank sensor 1 and a reference position provided by the cam sensor 6. In this embodiment, it is possible to determine whether the rotational position is the TDC of cylinder #2A or the TDC of cylinder #4B from a distance to an edge of the signal generated by the cam sensor 6 where cylinders #2A and #4B are 2 of the 8 cylinders. Then, once the reference position has been detected, the crank counter Scm_CCRNK is incremented at intervals of 30 degrees CA to identify a rotational position of the crankshaft 2.

Figure 9:
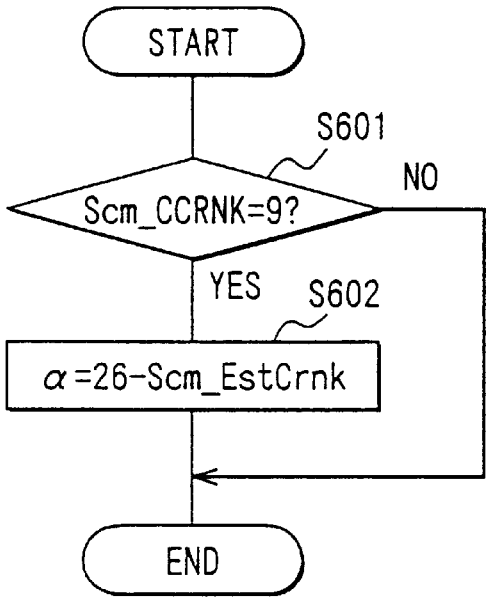
FIG. 9 is a flowchart representing correction processing in the first embodiment of the present invention.

FIG. 9 is a flowchart representing processing to find a correction value α. This processing is carried out each time the crank counter Scm_CCRNK reaches 9 after the first identifying processing. At S601, the crank counter Scm_CCRNK is examined to determine whether the crank counter Scm_CCRNK is equal to 9. If the crank sensor 1 as well as the cam sensors 6 and 10 are assembled and installed in the engine 30 in accordance with design specifications, when the crank counter Scm_CCRNK reaches 9, the estimated crank counter Scm_EstCrnk should reach 26. If there is an assembly error, however, there may be a difference in supposed count value between the crank counter Scm_CCRNK and the estimated crank counter Scm_EstCrnk. At S602, a correction value α is calculated. In this processing, a correction value α is learned. In processing at S104 and other processing, the shift α is taken into consideration. Thus, the difference is corrected.

Figure 10:
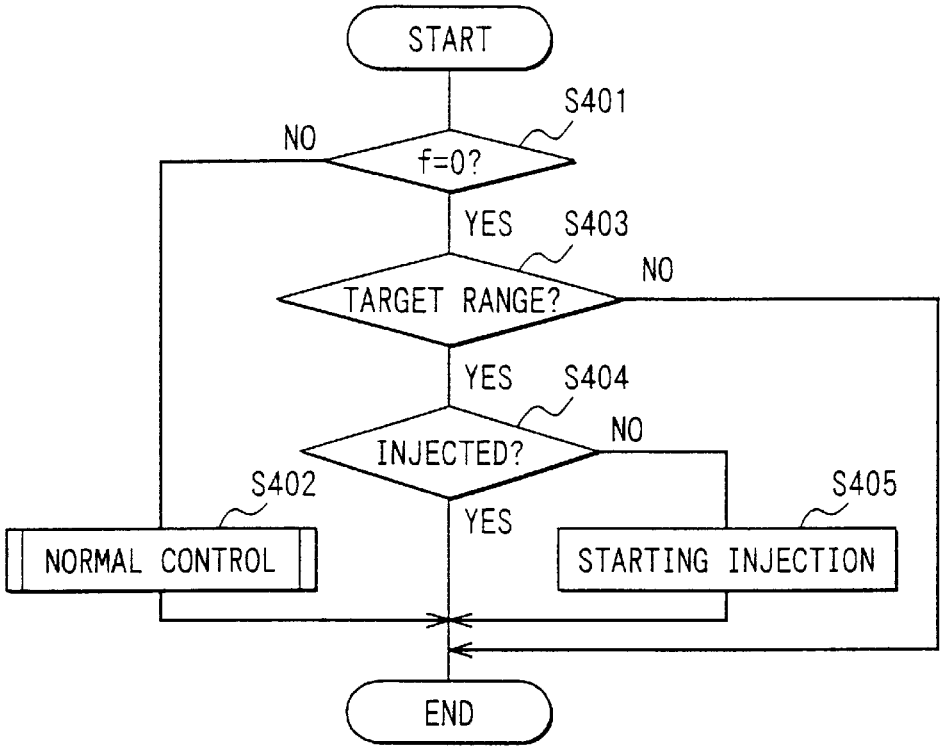
FIG. 10 is a flowchart representing fuel-injection control in the first embodiment of the present invention.
Figure 11:
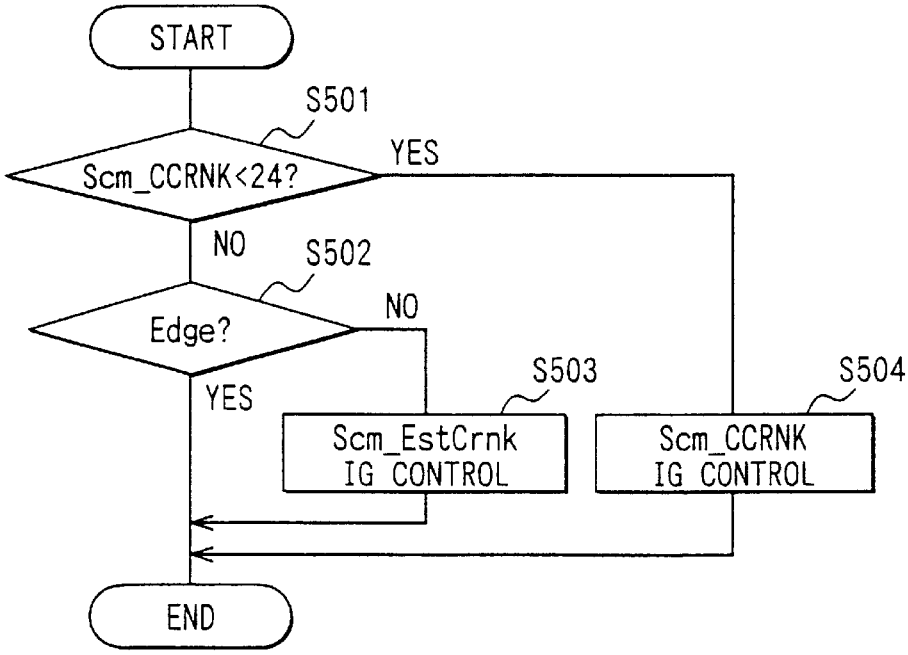
FIG. 11 is a flowchart representing ignition-timing control in the first embodiment of the present invention.
Figures 12, 12A:
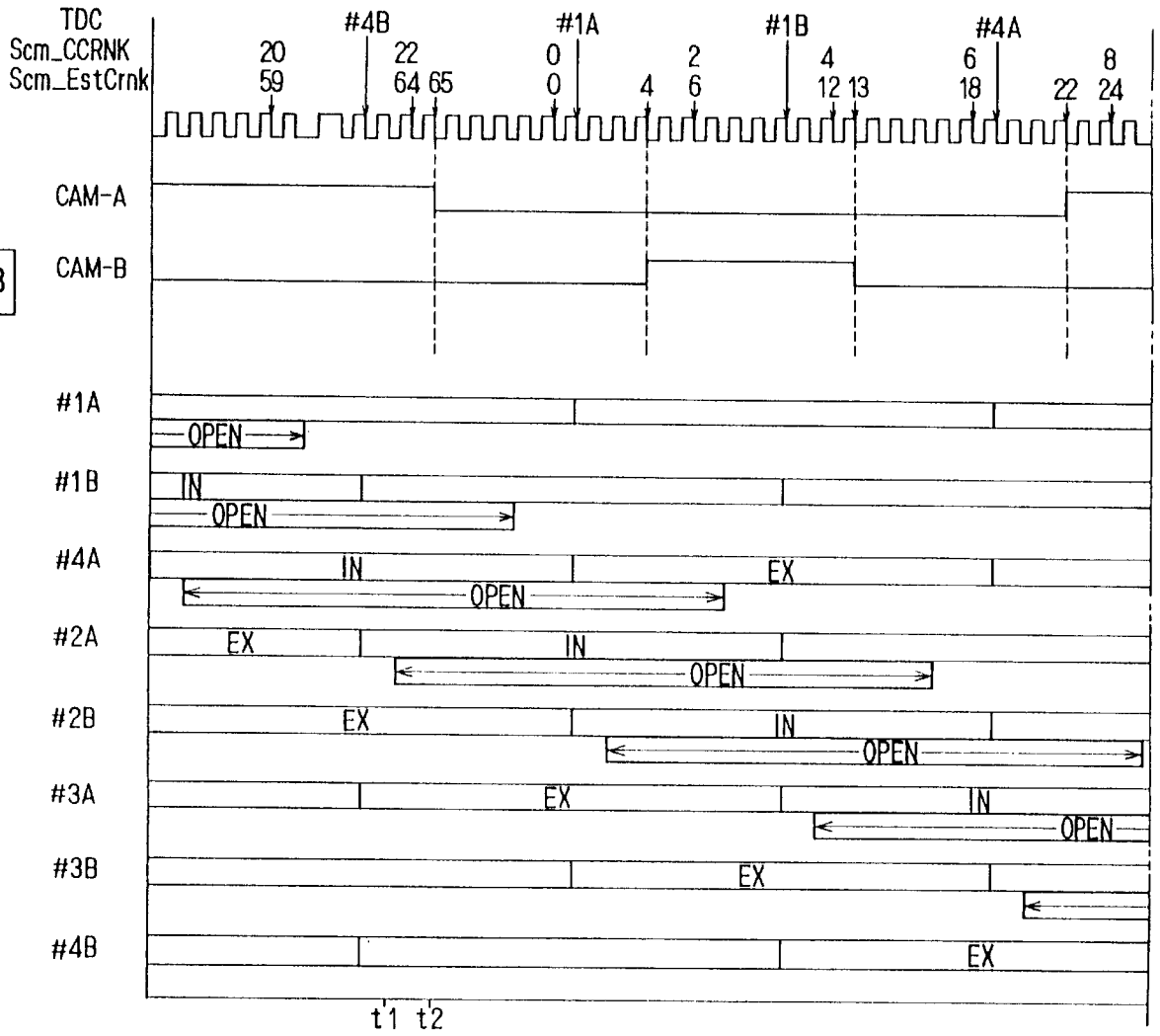
FIG. 12A is time charts of signal waveforms in the first embodiment of the present invention.
Figure 12B:
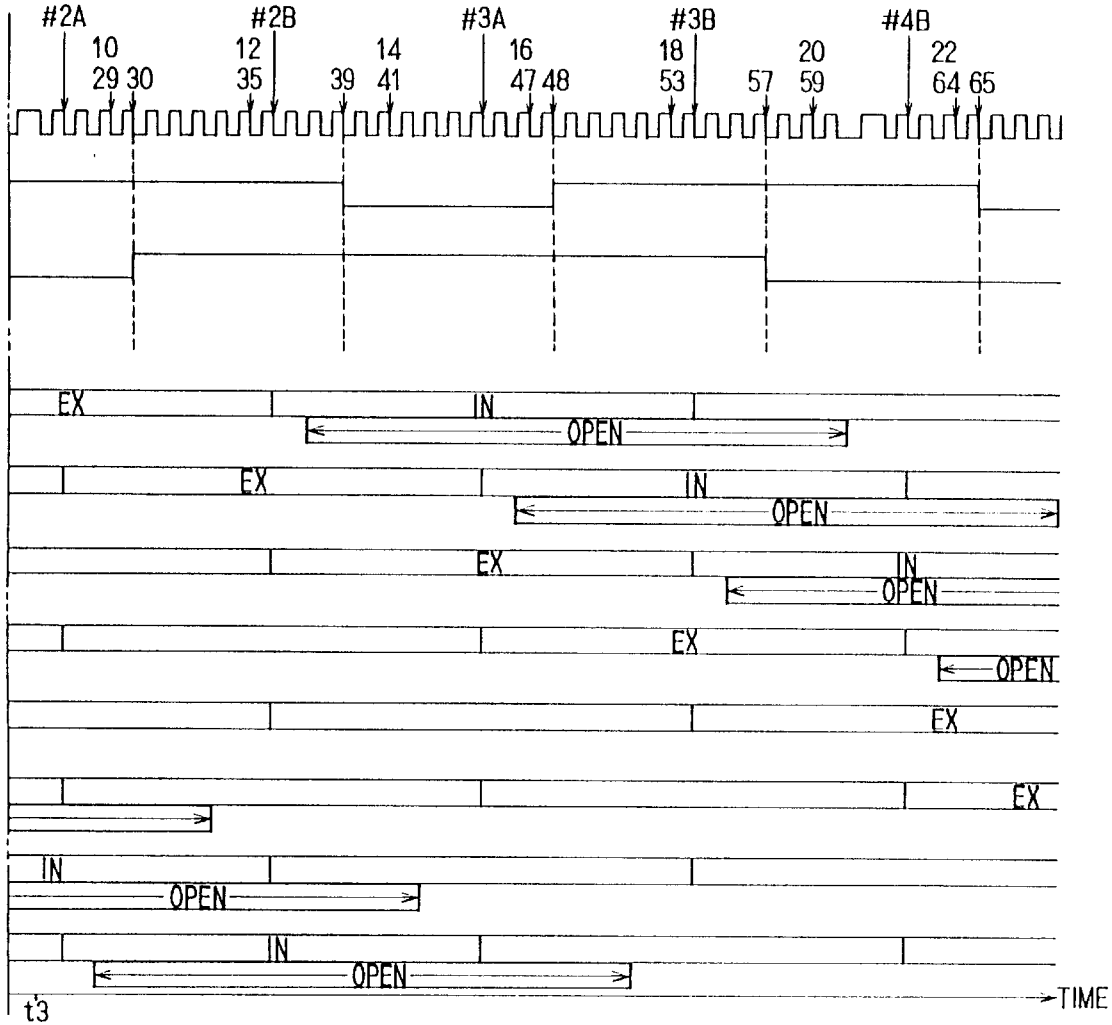
FIG. 12B is time charts of signal waveforms in the first embodiment of the present invention.

FIGS. 10 and 11 are each a flowchart representing control of the engine 30. Specifically, FIG. 10 is a flowchart representing fuel-injection control and FIG. 11 is a flowchart representing ignition-timing control. The fuel-injection control and the ignition-timing control are executed in accordance with the rotational position of the crankshaft 2. As described above, the rotational position of the crankshaft 2 is identified in the first or second identifying processing. Typically, the fuel-injection routine is interrupt processing activated in response to a signal generated by the crank sensor 1. In this case, a rotational position identified in the second identifying processing is tentatively used in the control of the engine 30 during a period, which is ended when a rotational position is provided from the first identifying processing.

The flowchart shown in FIG. 10 begins with S401 to examine a flag f for indicating that the first identifying processing has been carried out. A flag f set at 1 indicates that the first identifying processing has been carried out. If the flag f is set at 1, the flow of the processing goes on to S402 at which the normal fuel-injection control is executed. In the normal fuel-injection control, a fuel-injection volume is computed in accordance with the operating state. Then, a fuel-injection timing is determined on the basis of the crank counter Scm_CCRNK. In this case, the fuel-injection timing is determined by also considering the intake valve's opening/closing timings given by the VCTs 34 and 35. The opening/closing timings of the intake valve are detected from an angular difference between a signal generated by the crank sensor 1 and a signal generated by the cam sensor 6 as well as the signal generated by the crank sensor 1 and a signal generated by the cam sensor 10.

If the flag f is reset at 0, on the other hand, the flow of the processing goes on to S403. At S403, the estimated crank counter Scm_EstCrnk is examined to determine whether the count value of the estimated crank counter Scm_EstCrnk has reached a target area. The target area is a range of an intake BTCD 90 degrees CA to an intake ATCD 30 degrees CA of a cylinder to be subjected to the next fuel injection. The cylinder to be subjected to the next fuel injection is identified from the count value. If the count value of the estimated crank counter Scm_EstCrnk has not reached the target area, the execution of this routine is terminated.

If the count value of the estimated crank counter Scm_EstCrnk is determined to have been in the target area, the flow of the processing goes on to S404 to determine whether the cylinder to be subjected to the next fuel injection has been subjected to fuel injection. The processing of S404 is carried out to limit the number of times the fuel injection is carried out at next S405 to only once a period of 1 cycle only. If the cylinder to be subjected to the next fuel injection is determined to have not been subjected to fuel injection, the flow of the processing goes on to S405 at which advanced fuel injection is carried out. It should be noted that this fuel injection is starting fuel injection for starting the engine 30. If the cylinder to be subjected to the next fuel injection at S405 is determined to have already been subjected to the fuel injection, on the other hand, the execution of this routine is ended. As a result, only during the period of 1 cycle of the engine 30, that is, a period of 720 degrees CA, is the fuel injection based on the estimated crank counter Scm_EstCrnk carried out. Normally, however, the first identifying processing is successful within a range of 360 degrees CA. Thus, the flow of the processing goes on to S402 before the limiting function of S404 is executed. As a result, continuous rotation of the engine 30 can be assured.

In this embodiment, fuel-injection control is executed on the basis of a rotational position identified by the second identifying processing before a rotational position can be identified by the first identifying processing. Thus, it is possible to carry out fuel injection according to the rotational position of the engine 30 at an early time after the start of a cranking operation. In this embodiment, fuel injection is carried out at a point of time the rotational position identified in the second identifying processing reaches a target area. The fuel injection can thus be started at an early time. In addition, effects of the VCTs 34 and 35 can also be eliminated. By setting a range of an intake BTCD 90 degrees CA to an intake ATCD 30 degrees CA as a target area, fuel can be injected during a period an intake valve is opened and supplied to a combustion chamber. It should be noted that the target area is not limited to the range adopted in this embodiment.

The ignition-timing control represented by the flowchart shown in FIG. 11 is interrupt processing, which is carried out each time the crank sensor 1 generates a signal after the second identification becomes successful. The flowchart begins with S501 to determine whether the first identifying processing has been carried out. This embodiment determines whether the first identifying processing has been carried out by determination as to whether the crank counter Scm_CCRNK is smaller or greater than 24. If the first identifying processing is determined to have been carried out, the flow of the processing goes on to S504 at which ignition-timing control is executed on the basis of the crank counter Scm_CCRNK. In detail, at S504, an ignition timing set for an operating condition is found from a map showing a relation between the ignition timing and the operating condition, which is represented by the engine revolution speed Ne and the load of the internal combustion engine 30. Then, a spark is generated at the ignition plug as the rotational speed of the crankshaft 2 indicated by the crank counter Scm_CCRNK reaches the found ignition timing.

If the result of determination obtained at S501 indicates that the first identifying processing has not been carried out, on the other hand, the flow of the processing goes on to S502 to determine whether a signal edge is detected. If a signal edge is detected, the flow of the processing goes on to S503 at which ignition-timing control is executed on the basis of the estimated crank counter Scm_EstCrnk. In detail, at S502, an ignition timing set for an operating condition is found from the map showing a relation between the ignition timing and the operating condition, which is represented by the engine revolution speed Ne and the load of the internal combustion engine 30. Then, a spark is generated at the ignition plug as the rotational speed of the crankshaft 2 indicated by the estimated crank counter Scm_EstCrnk reaches the found ignition timing.

It is desirable to execute at least one of the fuel-injection control and the ignition-timing control after edges of the signals generated by both the cam sensors 6 and 10 have been detected. Assume for example that one of the cam sensors 6 and 10 is out of order so that the normal second identifying processing cannot be carried out. In this case, it is desirable to execute the engine control after waiting for the first identifying processing to become successful. In this way, it is possible to avoid undesirable states such as unstable combustion and deteriorating emission.

The ECU 20 also controls the VCTs 34 and 35. The ECU 20 is provided with a first means 20*a* for finding a first phase difference between the crankshaft 2 and the camshaft 7A and a second means 20*b* for finding a second phase difference between the crankshaft 2 and the camshaft 7B. In addition, the ECU 20 also has a target-value-setting means 20*c* for setting a target phase difference for an operating state of the engine 30. Furthermore, the ECU 20 is provided with a control means 20*d* for executing control to make the first and second phase differences equal to the target phase difference. The first and second phase differences are computed from the signals generated by the crank sensor 1, the cam sensor 6 and the cam sensor 10. For example, the first phase difference can be computed from a difference between a reference-position signal generated by the crank sensor 1 and an edge of the signal generated by the cam sensor 6.

Time charts of signals generated by a variety of components in this embodiment are shown in FIGS. 12A and 12B. The vertical axes in FIGS. 12A and 12B each represent items starting at the top with a cylinder about to reach a TDC followed by the count value of the crank counter Scm_CCRNK, the count value of the estimated crank counter Scm_EstCrnk, the waveform of the signal output by the crank sensor 1, the waveform of the signal output by the cam sensor 6, the waveform of the signal output by the cam sensor 10 and processes of the cylinders. In the figures, notation IN denotes an air intake process, notation EX denotes an exhaust process and notation OPEN denotes a period during which the intake valve is open.

Assume for example that the starting motor 16 is driven to crank the engine 30 from a time t1. In this case, the crank sensor 1 outputs a reference-position signal at a time t3 following a period of approximately 360 degrees CA. Thus, by merely carrying out the first identifying processing, a rotational position of the engine 30 cannot be identified during a period of about 360 degrees CA. In this embodiment, however, the second identifying processing is carried out to identify a rotational position of the engine 30. In the time charts shown in FIG. 12, the signal generated by the cam sensor 6 changes from a high level to a low level at a time t2. On this falling edge of the signal generated by the cam sensor 6, the signal generated by the cam signal 10 is at a low level. Thus, the estimated crank counter Scm_EstCrnk is set at 65. Then, in a period starting at the time t2, the engine 30 is controlled on the basis of the estimated crank counter Scm_EstCrnk. For example, at the time t2, cylinder #2A is detected to be in an intake process and the intake valve is detected to be in an open period. Thus, fuel can be injected to cylinder #2A.

In accordance with this embodiment, the rotational position of the engine 30 can be detected no later than a period of 90 degrees CA. Then, as the cranking of engine 30 is started, high-precision fuel-injection control and high-precision ignition-timing control can be implemented quickly. In addition, the cam sensors 6 and 10 can be used in the control of the VCTs 34 and 35.

In the first embodiment, the crank sensor 1 generates first reference-position signals at intervals of 360 degrees CA on the basis of the no-tooth portion 3*b*. Two first reference-position signals generated during a period of 720 degrees CA can be distinguished from each other by referring to the levels of the signals output by the cam sensors 6 and 10. During a period of 720 degrees CA, the cam sensors 6 and 10 generate 8 reference-position signals each representing a combination of a signal transition from one level to another and a signal level. The 8 reference-position signals include 6 reference-position signals that each have a timing different from the first reference-position signal.

This embodiment includes a second identifying means 20*e* for implementing processing represented by the flowcharts shown in FIGS. 4, 5 and 6. In addition, this embodiment also includes a first identifying means 20*f* for implementing processing represented by the flowcharts shown in FIGS. 7 and 8. Furthermore, this embodiment includes an engine control means 20*g* for implementing processing represented by the flowcharts shown in FIGS. 10 and 11.

Second Embodiment

Figures 13, 13A:
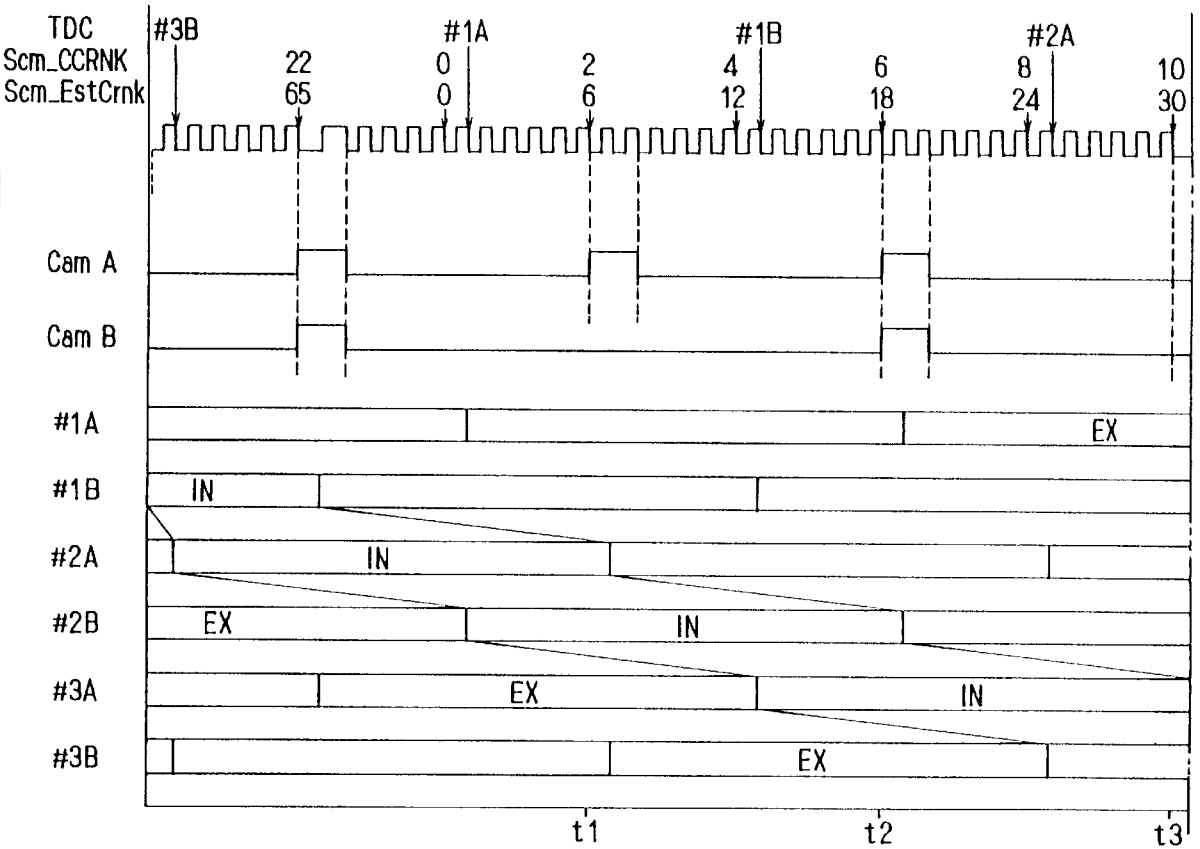
FIG. 13A is time charts of signal waveforms in a second embodiment of the present invention.
Figure 13B:
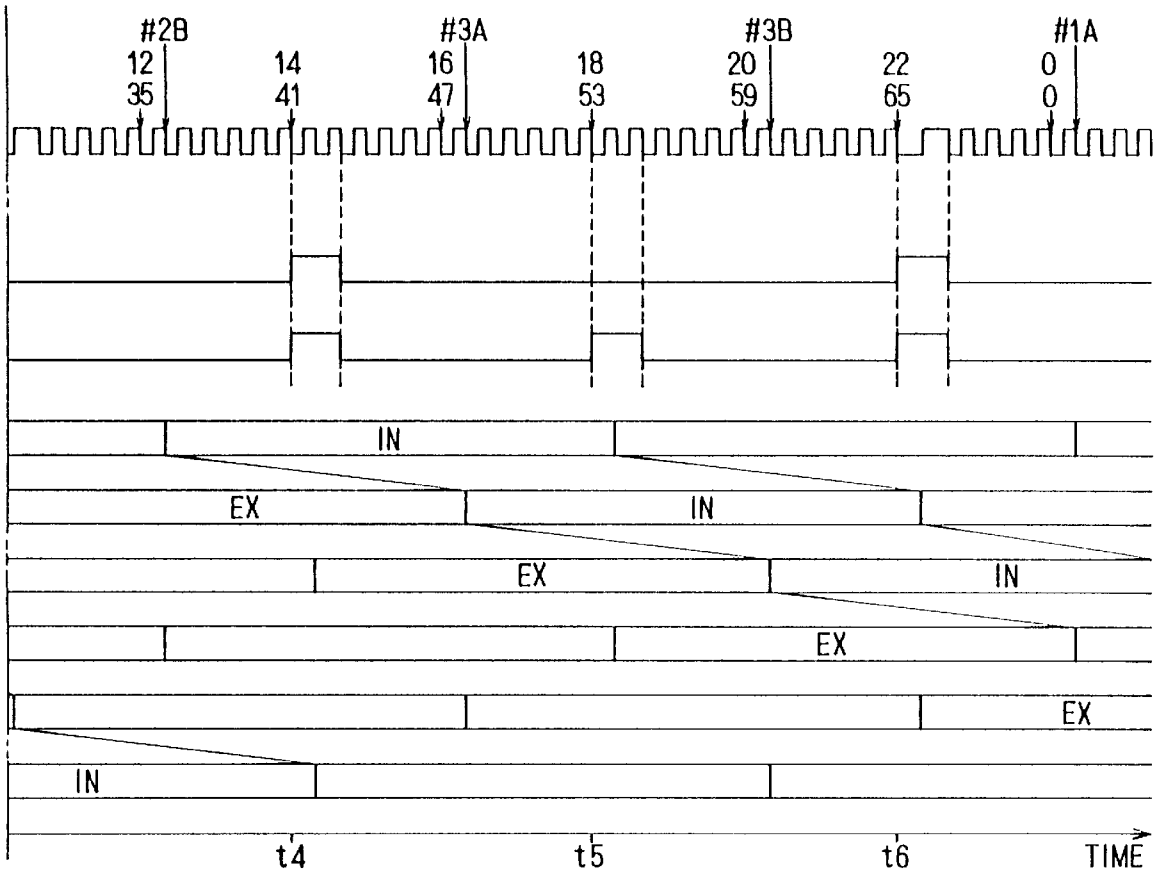
FIG. 13B is time charts of signal waveforms in the second embodiment of the present invention.

The present invention can also be applied to a V-type 6-cylinder engine. A V-type 6-cylinder 4-cycle engine has 3 cylinders for each bank. The combustion order is #1A→#1B→#2A→#2B→#3A→#3B. Time charts of signals generated by a variety of components in the second embodiment are shown in FIGS. 13A and 13B. The vertical axes in FIGS. 12A and 12B each represent items starting at the top with a cylinder about to reach a TDC followed by the count value of the crank counter Scm_CCRNK, the count value of the estimated crank counter Scm_EstCrnk, the waveform of the signal output by the crank sensor 1, the waveform of the signal output by the cam sensor 6, the waveform of the signal output by the cam sensor 10 and processes of the cylinders. This embodiment has the same configuration as that shown in FIG. 1. However, the shapes of the cam rotors 8 and 19 of the cam sensors 6 and 10 respectively are different. Specifically, the cam rotors 8 and 19 each have shapes corresponding to waveforms in the middle of the vertical axis in FIG. 13. In this embodiment, the cam sensors 6 and 10 each have 4 protrusions on the circumference. The 4 protrusions are provided at intervals of 120 or 240 degrees CA. The signals output by the 2 cam sensors 6 and 10 form a combination of Hi and Low levels only once during a period of 360 degrees CA. In the time charts shown in FIG. 13, the combination of the Hi and Lo levels occurs at a time t1 and the combination of the Lo and Hi levels occurs at a time t5.

In a period a reference-position signal from the crank sensor 1 is not obtained, the cam sensors 6 and 10 output the combination of the Hi and Lo signals. At the time t1, for example, the cam sensors 6 and 10 output signals at Hi and Lo levels respectively. In this case, the estimated crank counter Scm_EstCrnk is set at a count value of 6 indicating a rotational position of the crankshaft 2. At the time t5, on the other hand, the cam sensors 6 and 10 output signals at Lo and Hi levels respectively. In this case, the estimated crank counter Scm_EstCrnk is set at a count value of 53 indicating a rotational position of the crankshaft 2. At a time t2 or t4, the cam sensors 6 and 10 output signals both at a Hi level. In this case, the estimated crank counter Scm_EstCrnk is set at a count value of 18 or 41 respectively.

The first identifying means detects a reference position on the basis of a reference-position signal output by the crank sensor 1 as well as signals generated by the cam sensors 6 and 10 to identify a rotational position of the engine 30. When the signals output by the cam sensors 6 and 10 are both at a Hi level at the time the crank sensor 1 detects the no-tooth portion 3*b*, for example, the crank counter Scm_CCRNK is set at a count value of 22 indicating a rotational position of the crankshaft 2. When the signals output by the cam sensors 6 and 10 are both at a Lo level at the time the crank sensor 1 detects the no-tooth portion 3*b*, on the other hand, the crank counter Scm_CCRNK is set at a count value of 10 indicating a rotational position of the crankshaft 2. In accordance with this embodiment, the rotational position of the engine 30 can be detected no later than a period of 240 degrees CA.

In the second embodiment, the crank sensor 1 generates first reference-position signals at intervals of 360 degrees CA with timings coincident with the no-tooth portion 3*b*. Two first reference-position signals generated during a period of 720 degrees CA can be distinguished from each other by referring to the levels of the signals output by the cam sensors 6 and 10. The cam sensors 6 and 10 generate a second reference-position signal representing a combination of Hi and Lo levels in a period of 360 degrees CA. 2 second reference-position signals generated during a period of 720 degrees CA can be distinguished from each other by inverting the levels.

The present invention can be applied to not only a V-type engine but also an inline-type engine. For example, the present invention can be applied to an inline-type engine provided with a VCT on an intake cam, another VCT on an exhaust cam and a cam sensor provided for each of the cams. In addition, the present invention can also be applied to an engine having no VCT.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention defined in the appended claims.

What is claimed is:

1. An engine control system for a multi-cylinder engine, the engine control system comprising:

a crank sensor provided on a crankshaft of the multi-cylinder engine and used for outputting a signal indicating a rotational position of the crankshaft;

a cam sensor provided on a camshaft of the multi-cylinder engine and used for outputting a signal indicating a rotational position of the camshaft; and a first identifying means for identifying a rotational position of the multi-cylinder engine on the basis of an output of the cam sensor and an output of the crank sensor; and a second identifying means for identifying a rotational position of the multi-cylinder engine on the basis of an output of the cam sensor.

2. An engine control system according to claim 1, the engine control system further having a control means, which is used for controlling the multi-cylinder engine on the basis of the multi-cylinder engine's rotational position identified by the second identifying means when the second identifying means identifies the rotational position of the multi-cylinder engine before the first identifying means identifies a rotational position of the multi-cylinder engine.

3. An engine control system according to claim 2, the engine control system further having at least one of:

a fuel-injection control means for injecting fuel to a cylinder indicated by the multi-cylinder engine's rotational position identified by the second identifying means; and an ignition-timing control means for igniting gas in a cylinder indicated by the multi-cylinder engine's rotational position identified by the second identifying means.

4. An engine control system according to claim 3, wherein:

the multi-cylinder engine has a first camshaft and a second camshaft;

the cam sensor comprises a first cam sensor provided on the first camshaft and a second cam sensor provided on the second camshaft;

the first identifying means identifies a rotational position of the multi-cylinder engine on the basis of a signal generated by the crank sensor and at least one of cam-sensor signals generated by the first and second cam sensors;

the second identifying means identifies a rotational position of the multi-cylinder engine on the basis of the cam sensor signals generated by the first and second cam sensors; and the control means controls the multi-cylinder engine on the basis of the multi-cylinder engine's rotational position identified by the second identifying means during a period of time a rotational position of the multi-cylinder engine has not been identified by the first identifying means.

5. An engine control system according to claim 4, wherein combinations of different values of 2 signals generated by the first and second cam sensors each indicate one of a plurality of reference positions of the multi-cylinder engine.

6. An engine control system according to claim 4, wherein:

the crank sensor generates a signal indicating a reference position of the multi-cylinder engine; and the first and second cam sensors have a configuration indicating a reference position different from the reference position indicated by the crank sensor.

7. An engine control system according to claim 4, wherein the first and second cam sensors each generate a signal having 2 values represented by Hi and Lo levels of the signal.

8. An engine control system according to claim 7, wherein the second identifying means identifies a rotational position of the multi-cylinder engine in accordance with a combination of an edge of a signal generated by any one of the first and second cam sensors and a level of a signal generated by the other one of the first and second cam sensors.

9. An engine control system according to claim 8, wherein the signal edge is set in a 60-degrees-CA range following approximately a top dead center in an intake process of a predetermined cylinder of the multi-cylinder engine.

10. An engine control system according to claim 7, wherein the ignition-timing control means ignites gas in a cylinder indicated by the multi-cylinder engine's rotational position, which is identified by the second identifying means after a level transition of a signal generated by the first cam sensor and a level transition of a signal generated by the second cam sensor are both detected.

11. An engine control system according to claim 7, the engine control system further provided with a correction means for computing a difference between the engine control system's rotational position identified by the first identification means and the engine control system's rotational position identified by the second identification means and correcting the engine control system's rotational position identified by the second identification means.

12. An engine control system according to claim 1, wherein:

the cam sensor includes a first cam rotor having 2 protrusions and 2 dents as well as a second cam rotor also having 2 protrusions and 2 dents;

each rising or falling edge between the protrusions and the dents on the first and second cam rotors is positioned at a location coinciding with a cyclinder.

13. An engine control system for a multi-cylinder engine having a first camshaft and a second camshaft, the engine control system comprising:

a first cam sensor provided on the first camshaft and used for generating a signal changing a number of times, which is equal to at least half the number of cylinders employed in the multi-cylinder engine, during 1 rotation of the first camshaft;

a second cam sensor provided on the second camshaft and used for generating a signal changing a number of times, which is equal to at least half the number of cylinders employed in the multi-cylinder engine, during 1 rotation of the second camshaft; and a cylinder-identifying means for identifying a rotational position of the multi-cylinder engine on the basis of the signal generated the first cam sensor and the signal generated the second cam sensor.

14. An engine control system according to claim 13, wherein the cylinder-identifying means determines that a specific one of cylinders employed in the multi-cylinder engine is in a predetermined stroke when any one of the signal generated the first cam sensor and the signal generated the second cam sensor is changing and the other one of the signal generated the first cam sensor and the signal generated the second cam sensor has a predetermined magnitude.

15. An engine control system for a multi-cylinder engine, the engine control system comprising:

a crank sensor provided on a crankshaft of the multi-cylinder engine and used for outputting a signal indicating a first reference position;

a cam sensor provided on a camshaft of the multi-cylinder engine and used for outputting a signal indicating a second reference position different from the first reference position;

a variable valve timing unit for changing the camshaft's rotational phase relative to the crankshaft;

a valve timing control means for controlling the variable valve timing unit on the basis of a signal generated by the crank sensor and a signal generated by the cam sensor;

a first engine control means for detecting the first reference position and controlling the multi-cylinder engine on the basis of the first reference position; and a second engine control means for detecting the second reference position and controlling the multi-cylinder engine on the basis of the second reference position at least during a period ending with first detection of the first reference position.

16. An engine control system according to claim 15, wherein:

the crank sensor has a crank rotor for generating a signal indicating the first reference position at intervals of 360 degrees CA; and the cam sensor has a cam rotor for generating a signal of a Hi level at any one of 2 first reference positions detected during a period of 720 degrees CA, generating a signal of a Lo level at the other one of the 2 first reference positions and causing a transition between the Hi and Lo levels at the second reference position.

17. An engine control system according to claim 16, wherein:

the camshaft comprises a first camshaft and a second camshaft;

the cam sensor comprises a first cam sensor provided on the first camshaft and a second cam sensor provided on the second camshaft; and in addition to the signal indicating the second reference position, the first and second cam sensors further generate a signal indicating a third reference position different from the first and second reference positions.

18. An engine control system according to claim 15, wherein:

the crank sensor has a crank rotor for generating a signal indicating the first reference position at intervals of 360 degrees CA;

the camshaft comprises a first camshaft and a second camshaft;

the cam sensor comprises a first cam sensor provided on the first camshaft and a second cam sensor provided on the second camshaft;

the first cam sensor has a first cam rotor for generating a signal of a Hi level at any one of 2 first reference positions detected during a period of 720 degrees CA, a signal of a Lo level at the other one of the 2 first reference positions and a signal of a Hi or Lo level at the second reference position; and the second cam sensor has a second cam rotor for generating a signal of a Hi or Lo level at the second reference position during a period of 720 degrees CA.

19. An engine control system according to claim 15, wherein aid first and second engine control means control at least one of a fuel-injection timing and an ignition timing.

20. An engine control system according to claim 15, wherein the cam sensor generates a signal indicating as many reference positions as cylinders employed in the multi-cylinder engine.

* * * * *